US006085378A

United States Patent [19]

Petner

[11] Patent Number: 6,085,378

[45] Date of Patent: Jul. 11, 2000

[54] SELF-WRINGING SWAB MOP WITH SCRUBBER

[75] Inventor: Robert Petner, Burlington, N.J.

[73] Assignee: Quickie Manufacturing Corporation, Cinnaminson, N.J.

[21] Appl. No.: 09/351,363

[22] Filed: Jul. 12, 1999

[51] Int. Cl.[7] ..... A47L 13/144; A47L 13/12

[52] U.S. Cl. ..... 15/119.1; 15/116.1; 15/118

[58] Field of Search ..... 15/116.1, 116.2, 15/119.1, 119.2, 120.1, 120.2, 118

[56] References Cited

U.S. PATENT DOCUMENTS

| | | | |
|---|---|---|---|
| 603,999 | 5/1898 | Ballam | 15/115 |
| 2,472,781 | 6/1949 | Vosbikian | 15/115 |
| 3,946,457 | 3/1976 | Robinson | 15/119.1 |
| 4,491,998 | 1/1985 | Wilson | 15/116 |
| 4,809,387 | 3/1989 | Nakamura | 15/119 R |
| 5,060,338 | 10/1991 | Yates et al. | 15/119.2 |
| 5,488,750 | 2/1996 | Vosbikian | 15/119.2 |
| 5,724,694 | 3/1998 | Lewis | 15/119.1 |
| 5,875,509 | 3/1999 | Facca | 15/120.1 |
| 5,894,625 | 4/1999 | Vosbikian | 15/119.1 |

FOREIGN PATENT DOCUMENTS

| | | | |
|---|---|---|---|
| 185941 | 9/1922 | United Kingdom | 15/116.1 |
| 553287 | 5/1943 | United Kingdom | 15/116.1 |

*Primary Examiner*—Gary K. Graham
*Attorney, Agent, or Firm*—Stuart M. Goldstein

[57] ABSTRACT

A self-wringing swab type mop which has absorbent material strands and a hollow sleeve encompassing the mop handle. The sleeve is slidably mounted for movement along the handle and over the absorbent strands. A squeeze ring made up of a plurality of rollers is located within a housing permanently secured to the sleeve. The ring serves to squeeze moisture from the strands as the sleeve travels over the strands. When the sleeve is in position completely covering the strands, the mop presents a stable, compact unit, weighted at its end beneath the sleeve. In this position, an abrasive scrubber surface secured to the sleeve by means of an integral scrubber support can effectively and efficiently be used to clean ingrained soiled surfaces, without encumbrance from the mop strands. After cleaning is completed, the sleeve can be slidably retuned to its position off the strands over the handle, where it is locked in place by means of an interconnecting locking ring clamp. The mop can then again be used to continue cleaning or swabbing operations with the mop strands. The sleeve and its housing, which supports the scrubber, are secured together in desired alignment by means of sleeve tracks which guide the housing onto the sleeve to its final designated locked position on the sleeve.

38 Claims, 5 Drawing Sheets

SELF-WRINGING SWAB MOP WITH SCRUBBER

BACKGROUND OF THE INVENTION

Mops of various types and configurations have been used for cleaning soiled surfaces and for absorbing moisture for many years. It is similarly well known to employ a brush or other type of abrasive element on certain different varieties of mops, in order to increase the versatility of such mops. An abrasive surface element allows the added feature of scrubbing and cleaning ingrained soiled surfaces, thereby enhancing the capability and versatility of the standard mop with a soft mop head, which only functions efficiently when used for light surface cleaning or moisture absorption.

As early as the late nineteenth century, brush surfaces were added to mops, as seen in the pivoted press plate sponge mop shown in U.S. Pat. No. 603,999. Other examples of abrasive brush surfaces on mops of varied configurations include U.S. Pat. No. 2,472,781, showing a brush mounted on a one piece sponge mop; U.S. Pat. No. 4,491,998, disclosing an abrasive scrubber mounted on a roller type sponge mop; and U.S. Pat. No. 5,488,750, which employs a unique abrasive scrubber unit employed on a buttery sponge mop.

Self-wringing absorbent swab mops, like that shown in U.S. Pat. No. 4,809,387 have also been common for years. And recent mop technology has developed a self-wringing absorbent swab mop which uses a unique, slidably mounted hollow housing with a plurality of rollers attached to a squeeze ring in order to wring or squeeze moisture from the strands of the mop. However, this mop, illustrated in U.S. Pat. No. 5,724,694, and all prior similar self-wringing swab mops, do not have the efficient, unencumbered ingrained soiled surface scrubbing capability which other varieties of mops, like the sponge, roller, and butterfly mops referenced above, have. The swab mop shown in U.S. Pat. No. 5,875,509 discloses the use of a scrubber element, yet that element is placed on the ends of the mop strands themselves, making the use of the mop difficult and making the effective unencumbered use of the scrubber impossible. The placement and attachment of a scrubber element in this location also makes it susceptible to being easily torn from the mop upon extended use.

SUMMARY OF THE INVENTION

Accordingly, it is the object of the present invention to overcome the limitations and deficiencies of prior self-wringing swab mops.

It is the object of the present invention to increase the versatility of prior self-wringing swab mops.

It is the object of the present invention to provide a self-wringing mop with the capability of successfully cleaning ingrained soiled surfaces.

It is a further object of the present invention to provide a self-wringing mop with an abrasive cleaning surface which is designed and formed to be readily and easily used on swab mops.

It is still another object of the present invention to provide a self-wringing mop with efficient moisture wringing capability, which employs an integral scrubber support and abrasive surface to clean ingrained soiled surfaces.

It is a further object of the present invention to provide a self-wringing mop which employs an integral scrubber support and abrasive surface to clean ingrained soiled surfaces easily, in an unencumbered manner.

It is another object of the present invention to provide a self-wringing mop comprising a lightweight, yet compact unit which, when the integral scrubber support and abrasive surface of the unit is in its use position, can efficiently and effectively be employed to clean ingrained soiled surfaces.

It is yet another object of the present invention to provide a self-wringing mop with a scrubber surface which will be long lasting over extended periods of use.

It is a further object of the present invention to provide a self-wringing mop with an integral scrubber having a minimum of separate components which can be easily, efficiently, and economically manufactured.

It is still another object of the present invention to provide a self-wringing mop which can be easily and efficiently assembled properly in a designated position.

The present invention comprises a self-wringing mop with absorbent material strands and a hollow sleeve encompassing the mop handle. The sleeve is slidably mounted for movement along the handle and over the absorbent strands. A squeeze ring made up of a plurality of rollers is located within a housing permanently secured to the sleeve. The ring serves to squeeze moisture from the strands as the sleeve travels over the strands. When the sleeve is in position completely covering the strands, the mop presents a stable, compact unit, weighted at its end beneath the sleeve. In this position, an abrasive scrubber surface secured to the sleeve by an integral scrubber support can effectively and efficiently be used to clean ingrained soiled surfaces, without encumbrance from the mop strands. After cleaning is completed, the sleeve can be slidably returned to its position off the strands over the handle, where it is locked in place by means of an interconnecting locking ring clamp. The mop can then again be used to continue cleaning or swabbing operations with the mop strands. The sleeve and its housing, which supports the scrubber, are secured together in desired alignment by means of sleeve tracks which guide the housing onto the sleeve to its final designated locked position on the sleeve.

The novel features which are considered as characteristic of the invention are set forth in particular in the appended claims. The invention, itself, both as to its design, construction, and use, together with additional features and advantages thereof, are best understood upon review of the following detailed description with reference to the accompanying drawings.

DETAILED DESCRIPTION OF THE INVENTION

Figure 1:
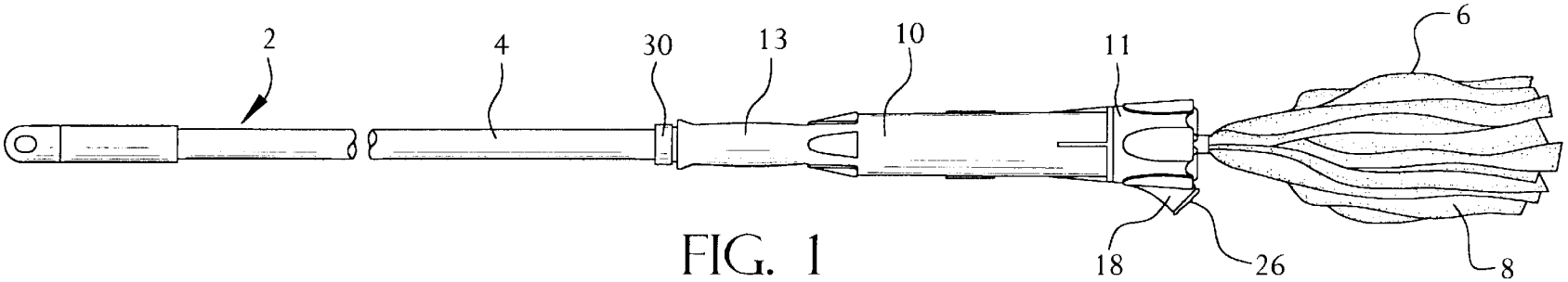
FIG. 1 is an elevation view of the mop of the present invention with its sleeve in a fully retracted position, locked onto the mop handle.

Mop 2 of the present invention comprises elongated rounded handle 4 with mop head 6. Mop head 6 consists of absorbent material strands 8 which are used for absorption of moisture and light cleaning of soiled surfaces, by a back and forth movement of mop 2 over the surfaces.

Sleeve 10 is elongated, cylindrical and hollow in configuration. It is positioned around handle 4 for slidable movement along the handle and then over strands 8 of mop head 6. The user can comfortably grasp sleeve 10 at section 13 of the sleeve.

At its end closest to mop head 6, sleeve 10 is secured to cylindrical sleeve housing 11, which has an integral scrubber support member 18, extending outwardly from outer surface 19 of the housing. Support member 18 is formed by side surfaces 22 and 23, which merge smoothly into outer surface 19 of housing 11. Rear surface 20 interconnects side surfaces 22 and 23 and these surfaces frame flat outer surface 24 of support member 18. Attached to flat outer surface 24 is an abrasive scrubber member 26. It will be appreciated that scrubber member 26 can be an abrasive pad, brush or similar course surface which can be permanently attached to outer surface 24 or attached by means of a Velcro ® or similar connection.

Housing 11 also supports a squeeze ring assembly 12 at its end closest to mop head 6. Squeeze ring assembly 12 is made up of a plurality of rollers 14*a*, 14*b*, 14*c*, 14*d* and 14*e* which frame opening 17. Rollers 14 are interconnected by pins 15 to support members 16*a*, 16*b*, 16*c*, 16*d*, and 16*e* at the end of housing 11. Rollers 14 are configured to constrict the size of opening 17.

Figure 2:
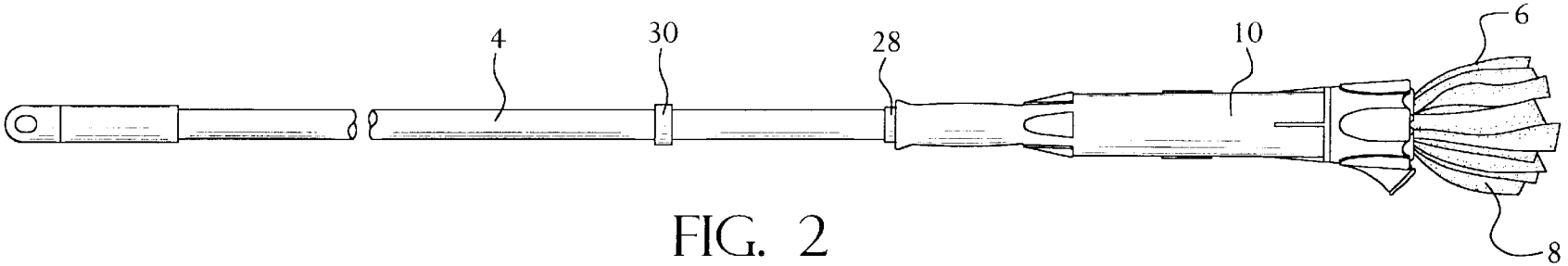
FIG. 2 is an elevation view of the mop with its sleeve positioned partially over its mop strands.

Sleeve 10 is slidable along handle 4 onto strands 8 by grasping the sleeve at 13 and exerting a pushing force in the direction of mop head 6. It can be appreciated that when sleeve 10 is slid over strands 8 of mop head 6, as shown in FIG. 2, rollers 14 expand slightly outward, while applying compressive forces to the strands. As sleeve 10 continues its path over mop head 6, the compressive forces, in turn, cause rollers 14 to squeeze out any moisture which is present in strands 8.

When sleeve 10 has traveled to the end of mop head 6 and squeeze ring assembly 12 is completely over and past strands 8, rollers 14 return to their original, contracted position. In actuality, after squeeze assembly ring 12 clears strands 8, rollers 14 immediately snap back into their contracted position.

Figure 3:
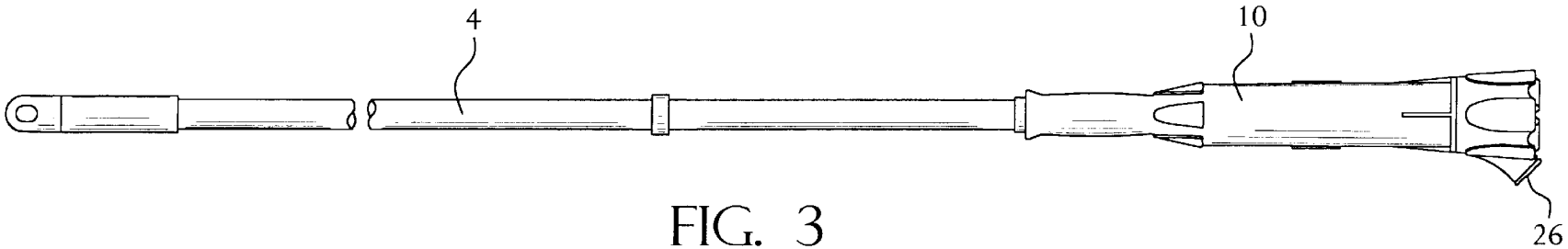
FIG. 3 is an elevation view of the mop with its sleeve position fully over the mop strands.

In this configuration, sleeve 10, completely covering mop head 6, is immovably secured in position, as shown in FIG. 3. Mop 2 is now one elongated compact unit, slightly weighted at its end, where sleeve 10 contains strands 8 which are damp, but free from wringable moisture. Mop 12 can now easily be positioned to advantageously use scrubber member 26 to clean ingrained soiled surfaces. The compact, end weighed state of mop 2 assists the user in easily performing this cleaning operation. That sleeve 10 is virtually locked over mop head 6, ensures that strands 8 are held tightly in place, so that vigorous cleaning by forceful back and forth movement of scrubber member 26 over ingrained soiled areas will be unencumbered by loose mop strands.

After cleaning with scrubber member 26 has been completed, sleeve 10 is grasped at 13 and pulled in the direction of the user, off mop head 6. This pulling force causes rollers 14 within squeeze ring assembly 12 to again expand over strands 8. Sleeve 10 is slid back up handle 4 towards the user, until lip 28 of the sleeve contacts locking ring clamp 30, which is secured to the handle. The contact between lip 28 and clamp 30 causes an interconnection between these components, locking sleeve 10 in place on handle 4. Clamp 30 is positioned on handle 4 at a designated location of the handle, which locks housing 10 such that the entire mop head 6 is uncovered, as shown in FIG. 1. This lip/locking configuration is similar to that which is disclosed in U.S. Pat. No. 5,724,694.

When it is desired to again wring strands 8 of moisture or use scrubber member 26, sleeve 10 is again grasped at 13 and pushed away from the user, towards mop head 6. This pushing action forces separation of the interconnection between clamp 30 and lip 28 of sleeve 10. Sleeve 10 is then free to be slid over mop head 6 once again.

Figure 7:
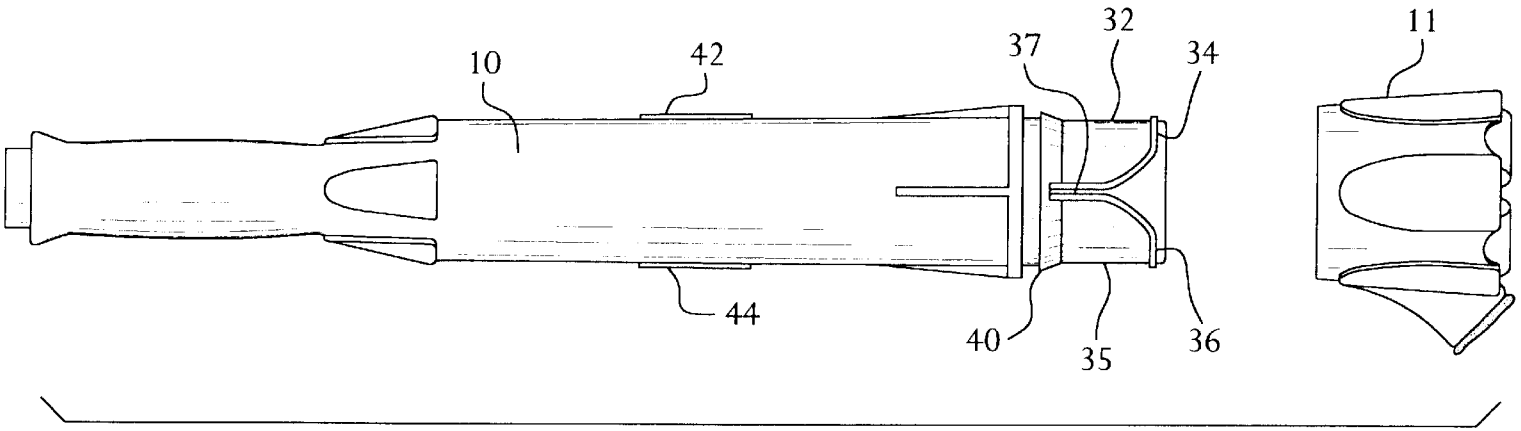
FIG. 7 is an elevation view showing the sleeve housing positioned in alignment with the sleeve prior to assembly of these two components.
Figure 8:
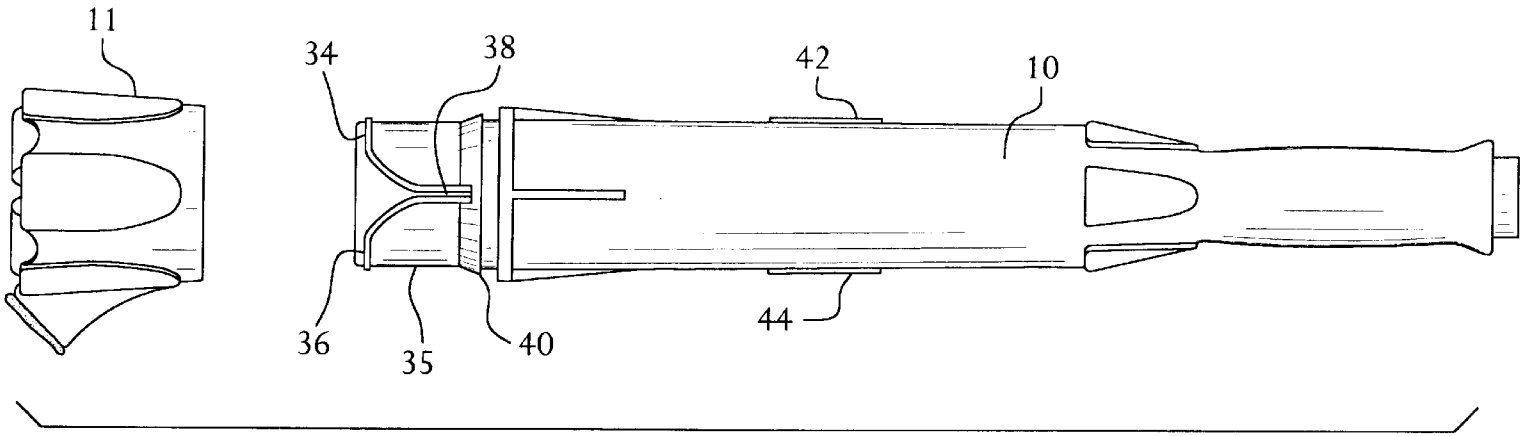
FIG. 8 is an elevation view of the opposite sides of the components shown in FIG. 7.

Housing 11 is immovably secured to the end of sleeve 10, in a novel manner. Two sets of tracks 34 and 36 protrude from outer surface 35 at end 32 of sleeve 10. Tracks 34 and 36 are symmetrically located and form two keyways 37 and 38, 180° apart, on surface 35. One of the keyways is shown at 37 in FIGS. 7 and the other at 38 in FIG. 8.

Figure 9:
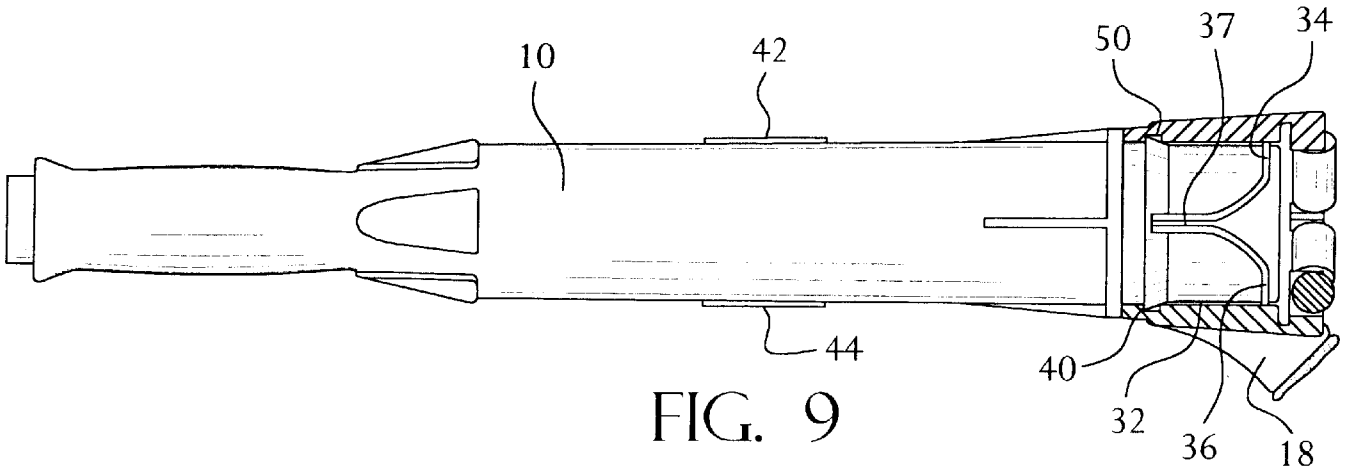
FIG. 9 is an elevation view showing the sleeve inserted into the sleeve housing, the housing shown in section view.

End 32 also comprises locking rim 40, protruding outwardly from and circumferentially around the end of sleeve 10. Logo markings 42 and 44 are located on opposite sides of sleeve 10, in locations 180° apart. In the embodiment shown in FIGS. 7–9, logo markings 42 and 44 are located on the outside surface of sleeve 10 so as to be at a spatial position of exactly 90° from the transverse plane in which both keyways 37 and 38 are located. It is contemplated that logo markings 42 and 44 can also be formed on sleeve 10 180° apart, so as to be centered and aligned with keyways 37 and 38, thus intersecting the transverse plane.

Figure 10:
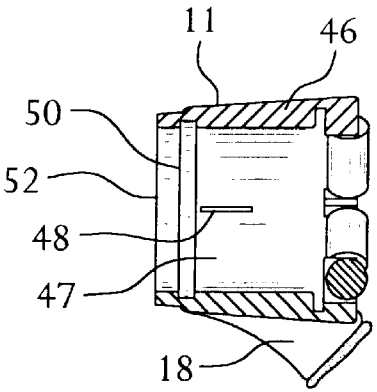
FIG. 10 is a section view of the sleeve housing.

Housing 11 if sleeve 10 is an integral, separately formed element comprising the scrubber support element 18 described above. Housing 11 itself comprises a main body portion 46 with an inner surface 47, two key tabs 48 protruding from the inner surface, and locking rim opening 50, located circumferentially around the inner surface of the housing. Key tabs 48 are positioned at locations 180° apart. One of the key tabs 48 is shown in FIG. 10. It can be appreciated that a similar key tab protrudes from inner surface 47 on the opposite side, or 180° from key tab 48 shown in FIG. 10. In the embodiment shown, scrubber support element 18 is located on the outer surface of housing 11 at a spatial position of exactly 90° from the transverse plane in which both key tab 48 are located. It is contemplated that scrubber support element 18 can also be located directly in alignment over either key tab 48, thus intersecting the transverse plane. Opening 52 of housing 11 is sized to be just a bit larger in diameter than the diameter of sleeve end 32.

It can thus be appreciated that housing 11 is assembled onto end 32 of sleeve 10 by aligning end 32 with housing opening 52 and aligning key tabs 48 with keyways 37 or 38. Housing 11 is then positioned over sleeve end 32 and pushed and pressed onto sleeve 10. Tracks 34 and 36 ensure that key tabs 48 enter keyways 37 and 38, thus ensuring that one of logos 42 or 44 is always in centered alignment with scrubber support element 18 and scrubber member 26. As housing 11 is pressed further onto sleeve 10, locking rim 40 of sleeve 10 is forced into locking rim opening 50 of the housing, thus locking the housing securely onto the sleeve end 32.

Figure 4:
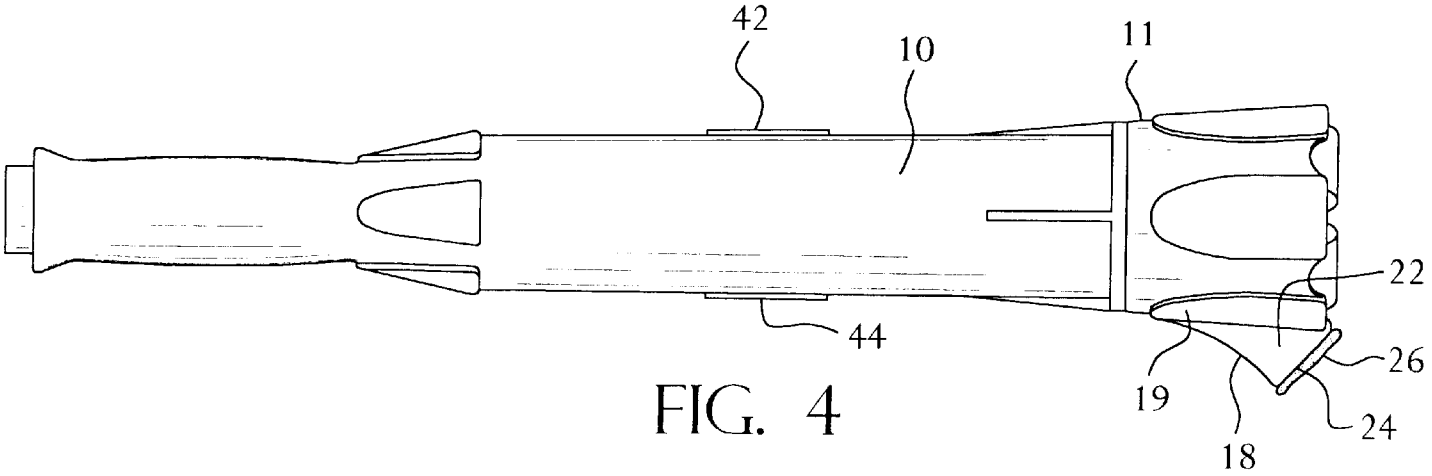
FIG. 4 is an elevation view of the sleeve with the sleeve housing secured to the end of the sleeve.
Figure 5:
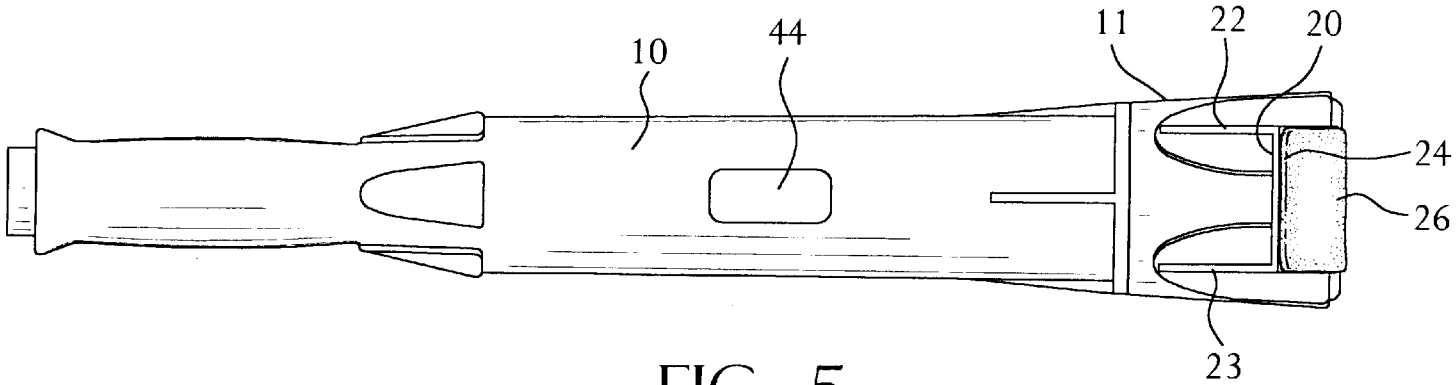
FIG. 5 is an elevation view of the mop with the sleeve housing secured to the end of the sleeve.
Figure 6:
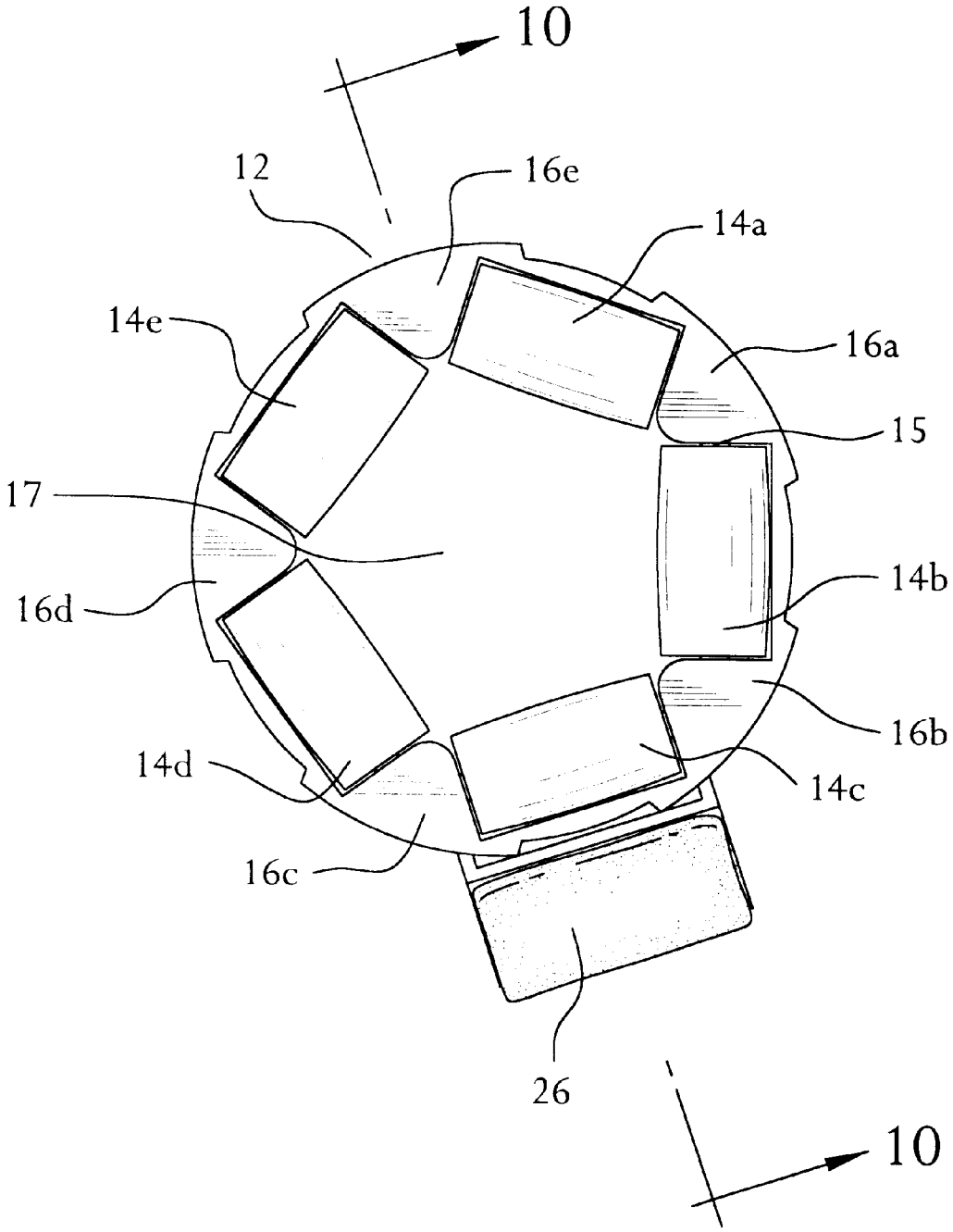
FIG. 6 is an end view of the sleeve housing.

Assembly of housing 11 to sleeve 10 in this manner ensures that the housing will always be installed and locked onto end 32 of the sleeve in one of two positions; a first position in which one of the logos is aligned with scrubber support element 18 or a second position, 180° from the first. This in turn ensures that scrubber member 26 will always be installed and remain in alignment with one of the two logo markings 42 or 44, as shown in FIGS. 4 and 5. It is important, both from an aesthetic and, hence a marketability standpoint, that the logo marking is properly positioned on the completed product and remains secured in this position during use.

It is contemplated that housing 11 and sleeve 10 are to be manufactured, most advantageously molded, independently of each other, as separate, solid integral components.

Certain novel feature and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

What is claimed:

1. A mop comprising:

(a) an elongated handle with a mop head secured at one end, said mop head comprising a plurality of absorbent material strands;

(b) hollow sleeve means positioned around and over the handle, said sleeve means being positioned for slidable movement along the handle and entirely over the strands of the mop head;

(c) mop head wringer means supported by said sleeve means for squeezing moisture from the strands of the mop head;

(d) abrasive scrubber means for cleaning ingrained soiled surfaces, said scrubber means being permanently fixed in a single immovable position in relation to the sleeve means;

(e) an abrasive scrubber support extending outwardly from the sleeve means, said support being permanently fixed in a single immoveable position on the sleeve means and having outer surface means defining a planar surface on which the abrasive scrubber means is located, the support further comprising a rear surface and side surfaces which integrally merge smoothly into the sleeve means, said rear and side surfaces framing the outer surface means, the sleeve means, and scrubber support with its outer surface means comprising one rigidly formed unitary element, whereby when the unitary element is slidably moved entirely over the strands of the mop head, the abrasive scrubber means can be used for unencumbered cleaning of ingrained soiled surfaces.

2. The mop as described in claim 1 in which the sleeve means has a mop end and a locking end and the scrubber support is located at the mop end of the sleeve means.

3. The mop as described in claim 1 in which the sleeve means has a mop end and a locking end and the scrubber support is located at the mop end of the sleeve means.

4. The mop as described in claim 3 in which the abrasive scrubber means is adjacent to the mop end of the sleeve means.

5. The mop as described in claim 3 in which the locking end comprises sleeve locking means to secure the sleeve means to the handle when the sleeve means is slidably moved to a position in which the strands are totally uncovered.

6. The mop is described in claim 5 in which the handle comprises sleeve receiving means to secure the sleeve means in position on the handle when the strands are totally uncovered.

7. The mop as described in claim 1 in which the wringer means companies a squeeze ring assembly located within the sleeve means.

8. The mop as described in claim 7 in which the squeeze ring assembly comprises a plurality of rollers.

9. The mop as described in claim 1 in which the wringer means comprises a squeeze ring assembly located within the sleeve means.

10. The mop as described in claim 9 in which the squeeze ring assembly comprises a plurality of rollers.

11. The mop as described in claim 1 in which the sleeve means comprises an elongated integral sleeve and a separate integral sleeve housing.

12. The mop as described in claim 11 wherein the mop head wringer means is located in the housing.

13. The mop as described in claim 12 wherein the scrubber support is integral with and extends outwardly from the housing.

14. The mop as described in claim 11 wherein the scrubber support is integral with and extends outwardly from the housing.

15. The mop as described in claim 11 in which the sleeve and housing are immovably secured together by housing locking means.

16. The mop as described in claim 15 in which the housing locking means comprises a sleeve locking rim and a housing rim opening.

17. The mop as described in claim 11 in which the sleeve and housing are aligned and positioned in relation to each other by connection guide means.

18. The mop as described in claim 17 in which the connection guide means permits the sleeve and housing to be aligned and positioned in relation to each other only in a first position and a second position, one hundred and eighty degrees from the first position.

19. The mop as described in claim 18 in which the connection guide means comprises tracks forming keyways on the sleeve and guide keys in the housing.

20. The mop as described in claim 17 in which the connection guide means comprises tracks forming keyways on the sleeve and guide keys in the housing.

21. A mop comprising:

(a) an elongated handle with a mop head secured at one end, said mop head comprising a plurality of absorbent material strands;

(b) a hollow sleeve with an outer surface, said sleeve being positioned around and over the handle for slidable movement along the handle and entirely over the strands of the mop head;

(c) a housing comprising mop head wringer means for squeezing moisture from the strands of the mop head;

(d) housing locking means for connecting the sleeve to the housing in one of two positions, whereby upon alignment and positioning of the housing over the sleeve, the locking means immovably interconnects the housing to the sleeve.

22. The mop as described in claim 21 further comprising connection guide means which align and position the sleeve and housing in relation to each other.

23. The mop as described in claim 22 in which the connection guide means permits the sleeve and housing to be aligned and positioned in relation to each other only in a first position and a second position, one hundred and eighty degrees from the first position.

24. The mop as described in claim 23 in which the connection guide means comprises tracks forming keyways on the sleeve and guide keys in the housing.

25. The mop as described in claim 21 in which the connection guide means comprises tracks forming keyways on the sleeve and guide keys in the housing.

26. The mop as described in claim 21 wherein the housing locking means comprises a sleeve locking rim and a housing locking rim opening.

27. The mop as described in claim 21 wherein the housing further comprises abrasive scrubber means for cleaning ingrained soiled surfaces and an abrasive scrubber support having outer surface means for attaching the abrasive scrubber means.

28. A mop comprising:

(a) an elongated handle with a mop head secured at one end, said mop head comprising a plurality of absorbent material strands;

(b) hollow sleeve means positioned around and over the handle, said sleeve means being positioned for slidable movement along the handle and entirely over the strands of the mop head, the sleeve means comprising a separate integral sleeve housing and an elongated interval sleeve which is received within the sleeve housing, said sleeve housing and sleeve being immovably secured together by housing locking means;

(c) mop head wringer means supported by said sleeve means for squeezing moisture from the strands of the mop head;

(d) abrasive scrubber means for cleaning ingrained soiled surfaces;

(e) an abrasive scrubber support and extending outwardly from the sleeve housing, said support having outer surface means, the abrasive scrubber means being located on the surface means; the sleeve means, sleeve housing and scrubber support means comprising one rigidly formed unitary element, whereby when the unitary element is slidably moved entirely over the strands of the mop head, the abrasive scrubber means can be used for unencumbered cleaning of ingrained soiled surfaces.

29. The mop as described in claim 28 in which the housing locking means comprises a sleeve locking rim and a housing rim opening.

30. The mop as described in claim 28 in which the sleeve and housing are aligned and positioned in relation to each other by connection guide means.

31. The mop as described in claim 30 in which the connection guide means permits the sleeve and housing to be aligned and positioned in relation to each other only in a first position and a second position, one hundred and eighty degrees from the first position.

32. The mop as described in claim 31 in which the connection guide means comprises tracks forming keyways on the sleeve and guide keys in the housing.

33. The mop as described in claim 30 in which the connection guide means comprises tracks forming keyways on the sleeve and guide keys in the housing.

34. A mop comprising:

(a) an elongated handle with a mop head secured at one end, said mop head comprising a plurality of absorbent material strands;

(b) hollow sleeve means positioned around and over the handle, said sleeve means being positioned for slidable movement along the handle and entirely over the strands of the mop head, the sleeve means comprising an elongated interval sleeve and a separate integral sleeve housing, the sleeve and sleeve housing being immovably secured together by housing locking means comprising a sleeve lock rim and a housing rim opening;

(c) mop head wringer means supported by said sleeve means for squeezing moisture from the strands of the mop head;

(d) abrasive scrubber means for cleaning ingrained soiled surfaces;

(e) an abrasive scrubber support integral with and extending outwardly from the sleeve means, said support having outer surface means, for attaching the abrasive scrubber means, whereby when the sleeve means is slidably moved entirely over the strands of the mop head, the abrasive scrubber means can be used for unencumbered cleaning of ingrained soiled surfaces.

35. The mop as described in claim 34 in which the sleeve and housing are aligned and positioned in relation to each other by connection guide means.

36. The mop as described in claim 35 in which the connection guide means permits the sleeve and housing to be aligned and positioned in relation to each other only in a first position and a second position, one hundred and eighty degrees from the first position.

37. The mop as described in claim 36 in which the connection guide means comprises tracks forming keyways on the sleeve and guide keys in the housing.

38. The mop as described in claim 35 in which the connection guide means comprises tracks forming keyways on the sleeve and guide keys in the housing.

* * * * *